US009062419B2

(12) United States Patent
Yustus et al.

(10) Patent No.: US 9,062,419 B2
(45) Date of Patent: Jun. 23, 2015

(54) RAIL SYSTEM FOR JACKING TOWER

(71) Applicant: Konecranes Plc, Hyvinkää (FI)

(72) Inventors: Joe Yustus, Hartford, WI (US); Marcus Jones, Phoenix, AZ (US)

(73) Assignee: Konecranes Plc, Hyvinkää (FI)

( * ) Notice: Subject to any disclaimer, the term of this patent is extended or adjusted under 35 U.S.C. 154(b) by 184 days.

(21) Appl. No.: 13/797,904

(22) Filed: Mar. 12, 2013

(65) Prior Publication Data

US 2014/0263685 A1 Sep. 18, 2014

(51) Int. Cl.

| | |
|---|---|
| ***E01B 3/20*** | (2006.01) |
| ***E01B 3/24*** | (2006.01) |
| ***E01B 23/10*** | (2006.01) |
| ***E01B 9/66*** | (2006.01) |
| ***E01B 5/02*** | (2006.01) |
| ***B66C 7/08*** | (2006.01) |

(52) U.S. Cl.

CPC ... *E01B 3/20* (2013.01); *E01B 5/02* (2013.01); *E01B 3/24* (2013.01); *E01B 9/66* (2013.01); *B66C 7/08* (2013.01); *E01B 23/10* (2013.01)

(58) Field of Classification Search

CPC ..... E01B 3/20; E01B 3/22; E01B 3/24; E01B 9/62; E01B 9/66; E01B 5/02; E01B 23/10; E04H 12/344

USPC ..... 238/10 R, 26, 109, 112, 120, 122, 272, 238/281

See application file for complete search history.

(56) References Cited

U.S. PATENT DOCUMENTS

| | | | | |
|---|---|---|---|---|
| 461,741 | A * | 10/1891 | Dyer | 238/112 |
| 4,084,777 | A | 4/1978 | Lambert | |
| 4,161,144 | A | 7/1979 | Raugulis et al. | |
| 4,382,413 | A | 5/1983 | Kakehi et al. | |
| 5,063,716 | A | 11/1991 | Raikhlin | |
| 6,367,390 | B1 | 4/2002 | Okubo et al. | |
| 7,032,829 | B2 * | 4/2006 | Schwarzbich | 238/281 |
| 7,793,594 | B2 | 9/2010 | Lerchenmueller | |
| 7,971,692 | B2 | 7/2011 | Gebelin | |
| 8,011,142 | B2 | 9/2011 | Marioni | |

FOREIGN PATENT DOCUMENTS

| | | | |
|---|---|---|---|
| DE | 1254666 | B | 11/1967 |
| DE | 1506521 | A1 | 7/1969 |
| WO | 2008009249 | A1 | 1/2008 |

OTHER PUBLICATIONS

International Search Report and Written Opinion of the International Searching Authority for International Application No. PCT/IB2014/000294, dated Aug. 8, 2014, 11 pages.

* cited by examiner

*Primary Examiner* — Zachary Kuhfuss

(74) *Attorney, Agent, or Firm* — Michael Best & Friedrich LLP

(57) ABSTRACT

A rail system includes a track, a plurality of leveling members disposed below the track, and a plurality of adjustment mechanisms disposed between the track and the plurality of leveling members. Each of the adjustment mechanisms is coupled to the track and one of the leveling members. The adjustment mechanisms adjust a distance between the track and the respective leveling member.

21 Claims, 7 Drawing Sheets

RAIL SYSTEM FOR JACKING TOWER

FIELD OF THE INVENTION

The present invention relates to a rail system, and more particularly to a self-leveling rail system for a self-erecting jacking tower.

BACKGROUND OF THE INVENTION

Rail assemblies for large-scale towers are known. The rail assemblies are positioned below the towers, and are used to move one or more of the tower components. The rail assemblies generally include two separate, parallel tracks.

SUMMARY

In accordance with one construction, a rail system includes a track, a plurality of leveling members disposed below the track, and a plurality of adjustment mechanisms disposed between the track and the plurality of leveling members. Each of the adjustment mechanisms is coupled to the track and one of the leveling members. The adjustment mechanisms adjust a distance between the track and the respective leveling member.

In accordance with another construction, a rail system includes a first track, a second track coupled to the first track, a leveling member disposed below the first track, and a first adjustment mechanism disposed between the first track and the leveling member. The first adjustment mechanism includes a male mating component and a female mating component. The rail system also includes a second adjustment mechanism disposed between the first track and the leveling member, the second adjustment mechanism including a first link and a second link.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
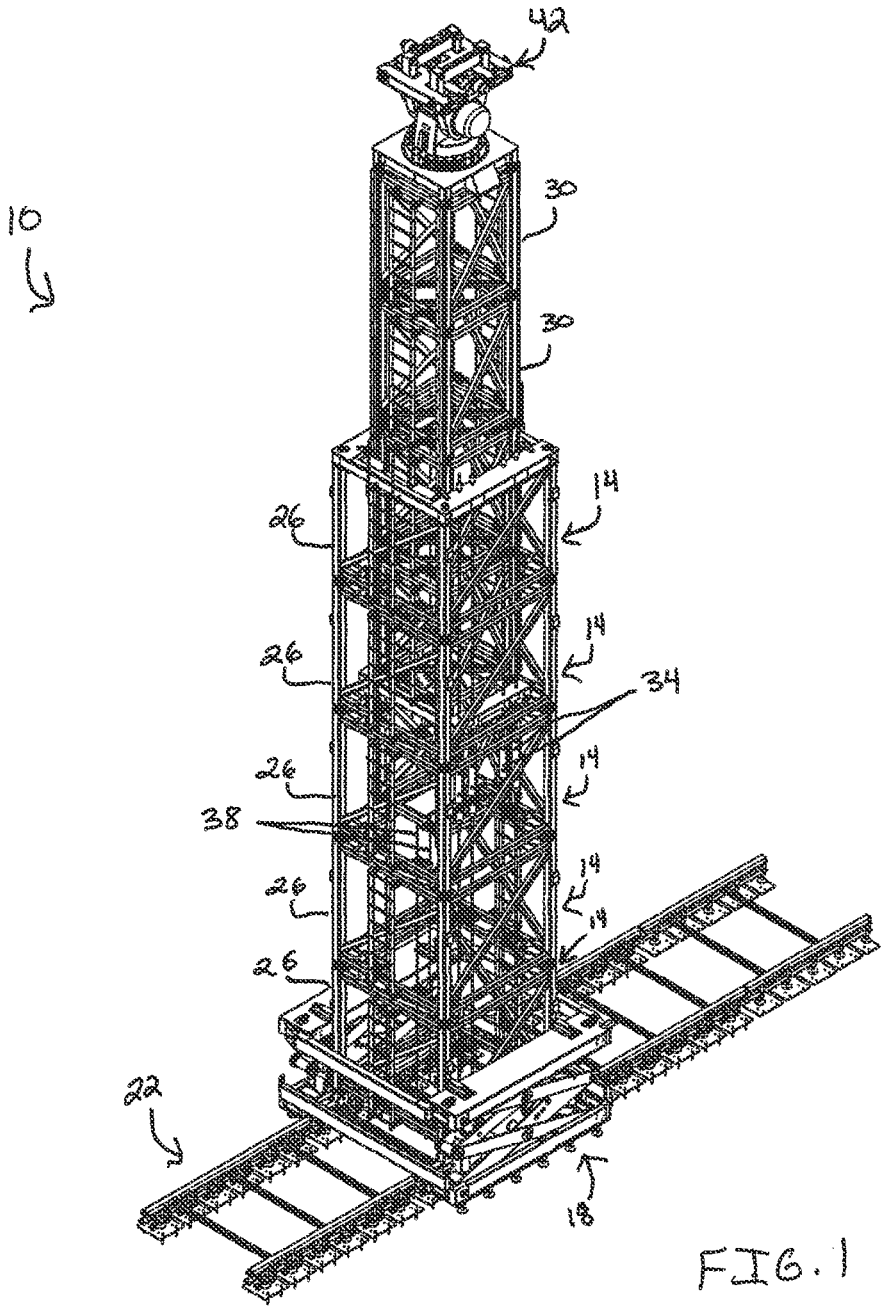
FIG. 1 is a top perspective view of a fully assembled self-erecting jacking tower according to one construction of the invention, including a rail system.
Figure 2:
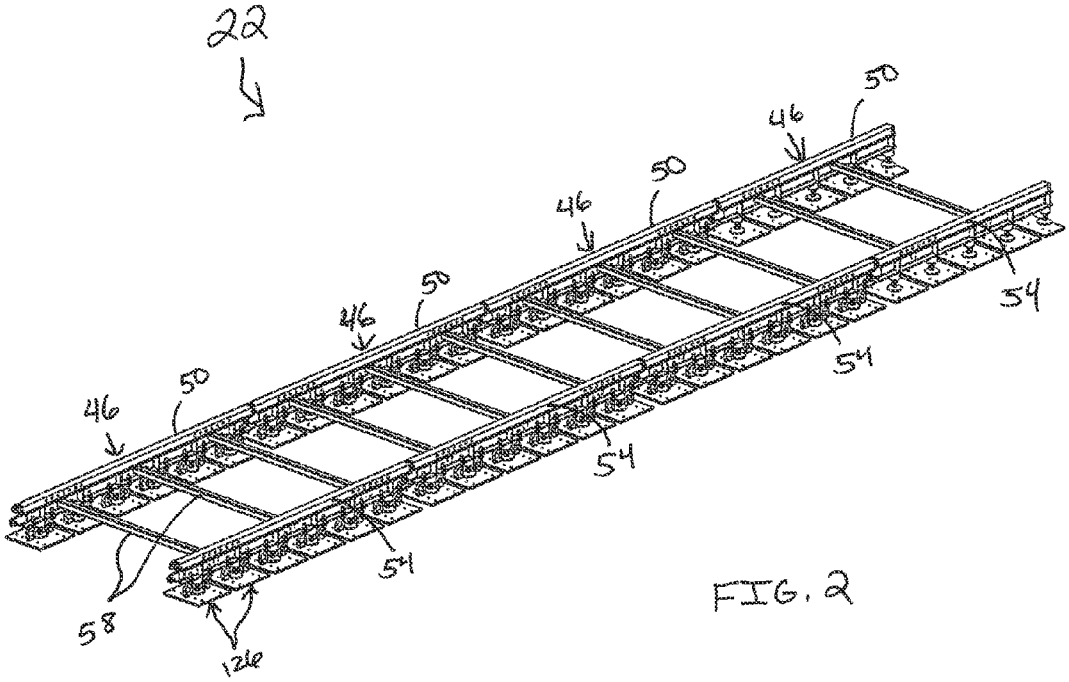
FIG. 2 is a top perspective view of the rail system of FIG. 1, the rail system including four modules coupled to one another.

FIG. 1 illustrates a fully assembled self-erecting jacking tower 10. Among other uses, the jacking tower 10 is used to install overhead cranes in industrial, commercial, and nuclear power plants.

With reference to FIG. 1 the jacking tower 10 includes a plurality of stacked module assemblies 14 that are raised and assembled with a scissors lift assembly 18 along a rail system 22. The module assemblies 14 include outer frames 26 and inner frames 30, the inner frames 30 being movable relative to the outer frames 26 via a plurality of strand jacks 34 and cables 38. The jacking tower 10 also includes a head assembly 42 positioned on top of and coupled to the stacked module assemblies 14.

With reference to FIGS. 2-5, the rail system 22 is a self-leveling rail system, configured to withstand seismic loads without shearing and/or breaking apart. The rail system 22 includes a plurality of rail modules 46. Each rail module 46 includes a first track 50 and a second track 54. The first and second tracks 50, 54 are separated by a plurality of cross-beams 58. The first tracks 50 run parallel to the second tracks 54, and the cross-beams 58 each run parallel to one another and perpendicular to both the first and second tracks 50, 54.

Figure 3:
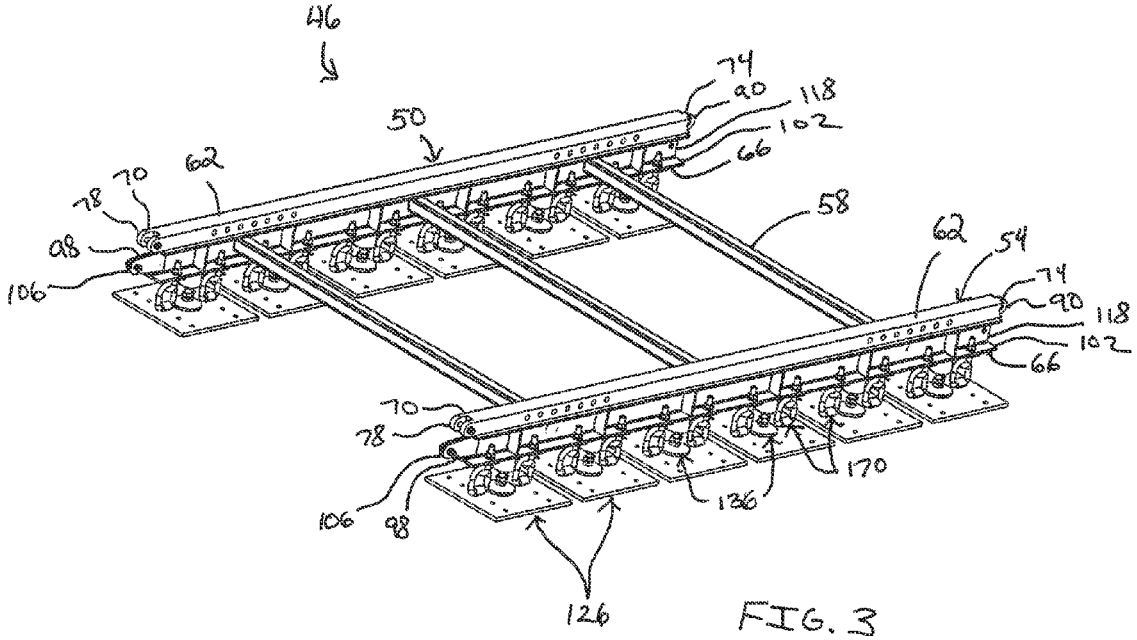
FIG. 3 is a top perspective view of one of the modules of FIG. 2.
Figure 4:
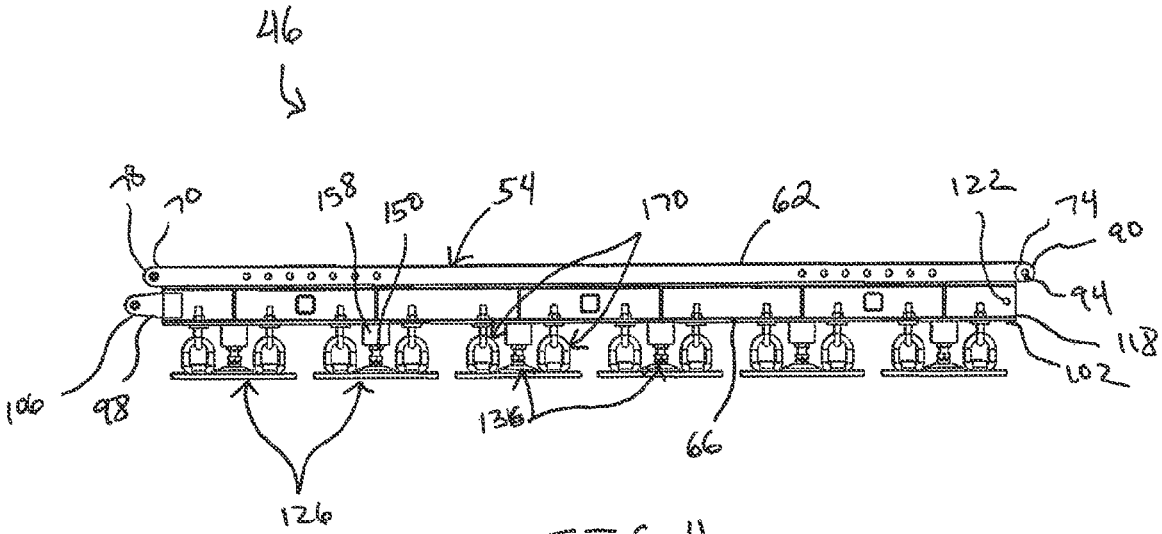
FIG. 4 is a side view of the module of FIG. 3.
Figure 5:
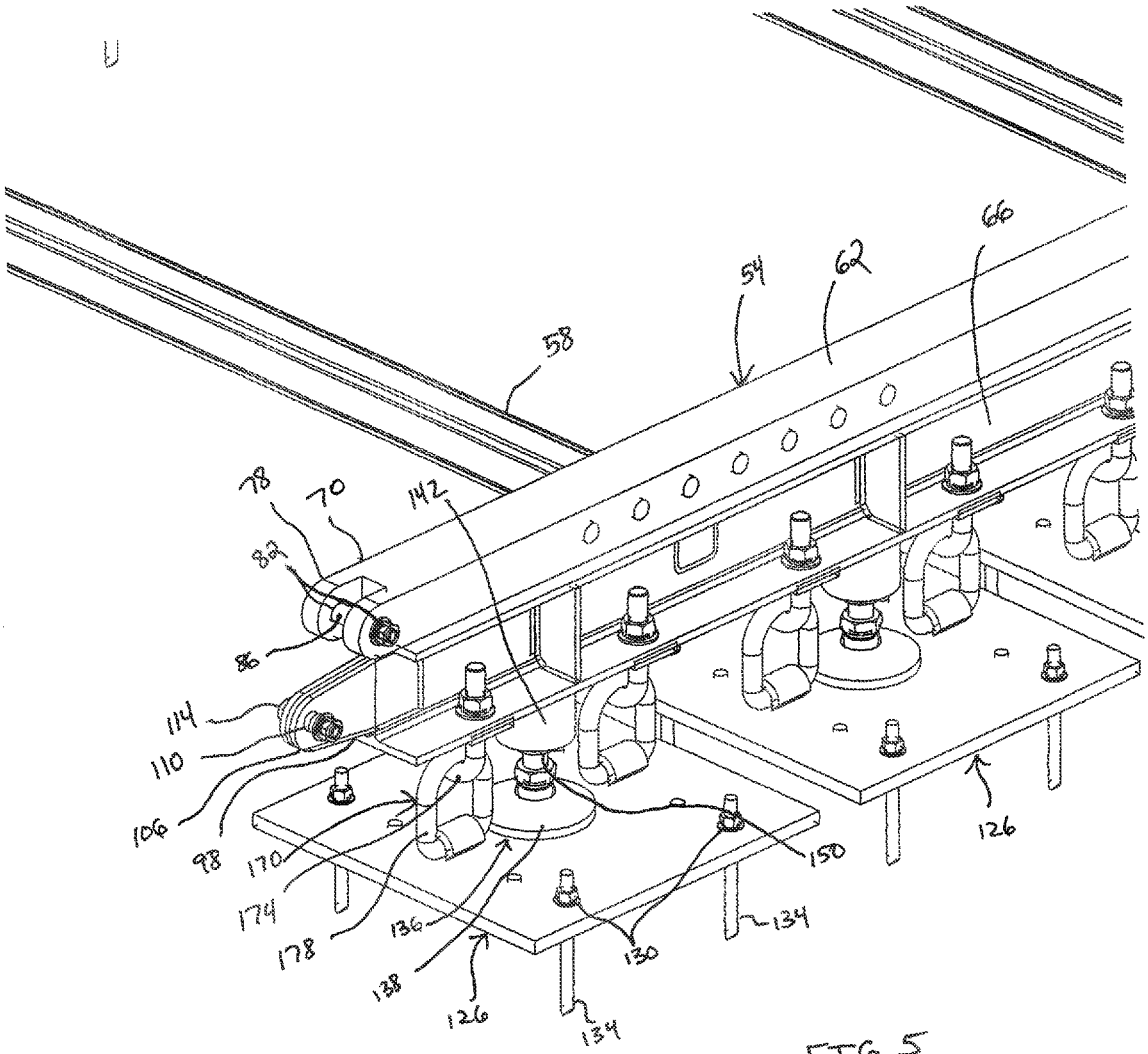
FIG. 5 is a partial, enlarged top perspective view of a portion of the module of FIG. 3, illustrating various adjustment mechanisms.

The rail modules 46 are coupled to one another, so as to form an elongate rail system 22 of varying length. As illustrated in FIGS. 3-5, each of the tracks 50, 54 includes a top portion 62 and a bottom portion 66. The top portion 62 includes a first end 70 and a second end 74. The first end 70 includes a coupling mechanism 78. As illustrated for example in FIG. 5, the coupling mechanism 78 is in the form of a forked member having apertures 82 for receiving a bolt 86. Other constructions include different forms or shapes. The second end 74 also includes a coupling mechanism 90. As illustrated in FIG. 4, the coupling mechanism 90 is in the form of a projection or flange including an aperture 94. Each coupling mechanism 90 is inserted into one of the coupling mechanisms 78 of another module 46, with the apertures 82, 94 aligned. Bolts 86 are inserted through the apertures 82, 94 to couple two modules 46 together.

With continued reference to FIGS. 3-5, each of the bottom portions 66 of the tracks 50, 54 includes a first end 98 and a second end 102. The first end 98 includes a coupling mechanism 106. As illustrated in FIG. 5, the coupling mechanism 106 is in the form of a forked member having apertures 110 for receiving a bolt 114. Other constructions include different forms or shapes. The second end 102 also includes a coupling mechanism 118. As illustrated in FIG. 4, the coupling mechanism 118 is in the form of a thin flange including an aperture 122. The coupling mechanism 118 is inserted into one of the coupling mechanisms 106 of another module 46, with the apertures 110, 122 aligned. Bolts 114 are inserted through the apertures 110, 122 to further couple the two modules 46 together.

With continued reference to FIGS. 2-5, the modules 46 include leveling members 126. In the illustrated construction, each leveling member 126 includes a thin, rectangular pad, though other constructions include different shapes and configurations. The leveling members 126 sit generally flat along a surface (e.g. a floor of an industrial, commercial, or nuclear power plant, etc.), and support the tracks 50, 54. Referring to FIG. 5, the leveling member 126 includes apertures 130 for receiving bolts 134. The bolts 134 are inserted through the apertures 130 to fasten the leveling members 126 to the surface underneath the leveling member 126.

Figure 6:
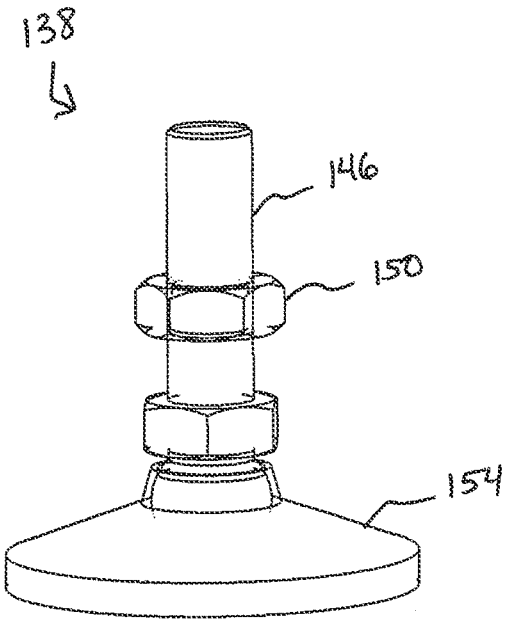
FIG. 6 is a top perspective view of a male mating component of one of the adjustment mechanisms of FIG. 5.
Figure 7:
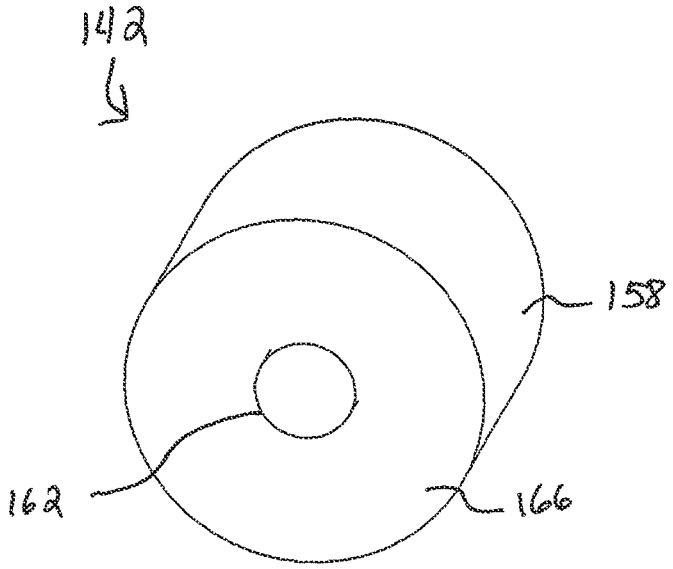
FIG. 7 is a bottom perspective view of a female mating component of one of the adjustment mechanisms of FIG. 5.

With reference to FIGS. 5-7, each of the leveling members 126 is adjustable relative to the tracks 50, 54, such that the tracks 50, 54 remain level even if the surface underneath is sloped (e.g. sloped 1 degree, 2 degrees, 3 degrees, etc.). The leveling member 126 is coupled to a first adjustment mechanism 136, which is coupled to one of the tracks 50, 54. Each of the first adjustment mechanisms 136 includes a male mating component 138 and a female mating component 142.

As illustrated in FIG. 6, the male mating component 138 includes an elongate rod 146 having an adjustable nut 150 coupled thereto. The male mating component 138 further includes a base 154, which is coupled to the leveling member 126. In the illustrated construction, the base 154 is tapered.

With reference to FIG. 7, the female mating component 142 includes a cylindrical member 158. The cylindrical member 158 includes an aperture 162 passing therethrough, and a bottom surface 166. The aperture 162 has a diameter equal to or greater than a diameter of the male component rod 146. The rod 146 slides within the aperture 162 to adjust a distance between the track 50, 54 and the leveling member 126.

In order to adjust a distance between one of the tracks 50, 54 and one of the leveling members 126, the adjustable nut 150 on the rod 146 is rotated and moved either up or down the rod 146. If the nut 150 is moved down the elongate rod 146 (i.e., toward the base 154), the rod 146 is able to move up farther into the aperture 162, thereby moving the leveling member 126 closer to the respective track 50, 54. If the nut 150 is moved up the rod 146 (i.e., away from the base 154), the rod 146 is no longer able to move as far into the aperture 162, thereby moving the leveling member 126 farther away from the respective track 50, 54. As illustrated in FIGS. 4 and 5, once the nut 150 is adjusted as desired, the cylindrical member 158 rests on and is supported by the nut 150. The nut 150 engages the cylindrical member 158 along the bottom surface 166 of the cylindrical member 158.

When mounting the rail system 22 to a surface, a distance between each of the plurality of leveling members 126 and a corresponding track 50, 54 is adjusted prior to inserting the bolts 134. If the surface is sloped (e.g., has a five degree grade), the distances between the leveling members 126 and the tracks 50, 54 are adjusted so that the tracks 50, 54 remain level (relative to gravity), despite the slope. Thus, the distances between the leveling members 126 and the tracks 50, 54 are greater at one end of the rail system 22 than at an opposite end of the rail system. With the ability to level the tracks 50, 54, concerns regarding a rail cart or other component unintentionally sliding down the rail system 22 (i.e., due to gravity) are alleviated.

With continued reference to FIGS. 1-5, the modules 46 further include second adjustment mechanisms 170. In the illustrated construction, each leveling member 126 includes two adjustment mechanisms 170. The adjustment mechanisms 170 are disposed on opposite sides of the corresponding first adjustment mechanism 136. Each of the adjustment mechanisms 170 is coupled to the corresponding track 50, 54 and leveling member 126.

With reference to FIG. 5, each adjustment mechanism 170 includes a first member 174 and a second member 178. The first member 174 is coupled to the second member 178. The first member 174 is coupled to one of the tracks 50, 54 (e.g., rigidly attached with fasteners) and the second member 178 is coupled to one of the leveling members 126 (e.g., rigidly attached with fasteners). In the illustrated construction, the first member 174 and second member 178 are links, and preferably the first member 174 is moveable relative to the second member 178. The first member 174 and the second member 178 permit translational (e.g., up and down) as well as rotational (e.g., about an axis perpendicular to the surface) movement of the first and second members 174, 178 relative to each other. The first and second members 174, 178 are moveably coupled to one another.

The first and second members 174, 178 provide seismic relief in the event of an earthquake or other event that may trigger movement of the surface to which a leveling member 126 is coupled. For example, if an earthquake strikes or there are vibrations in the surface for any reason, and one of the leveling members 126 is lifted up, the second member 178 is free to slide up within the first member 174 due to the linked nature of the first and second members 174, 178. This freedom of movement limits the amount of stress placed on the tracks 50, 54, on the module 46, and on the overall rail system 22, and inhibits fracture or damage to the rail system 22. This freedom of movement also facilitates a generally continuous, level set of tracks 50, 54, despite fluctuations in the position of the surface beneath the rail system.

The combination of the adjustment mechanisms 136, 170 advantageously allows a rail system 22 to remain generally level at all points along the tracks 50, 54, despite sloping grades on the surface below the rail system 22, or fluctuations in the position of the surface below the rail system 22.

Although the invention has been described in detail with reference to certain preferred embodiments, variations and modifications exist within the scope and spirit of one or more independent aspects of the invention as described.

What is claimed is:

1. A rail system comprising:

a track;

a plurality of leveling members disposed below the track; and a plurality of adjustment mechanisms disposed between the track and the plurality of leveling members, each of the adjustment mechanisms coupled to the track and one of the leveling members, wherein the adjustment mechanisms adjust a distance between the track and the respective leveling member;

wherein at least one of the plurality of adjustment mechanisms includes a first chain link coupled to the track and a second chain link coupled to both the first chain link and to the respective one of the plurality of leveling members.

2. The rail system of claim 1, wherein the first chain link is movable relative to the second chain link.

3. The rail system of claim 1, wherein one of the plurality of leveling members includes two adjustment mechanisms coupled to the leveling member.

4. The rail system of claim 3, wherein each of the two adjustment mechanisms includes a first chain link coupled to the track and a second chain link coupled to both the first chain link and to the leveling member.

5. The rail system of claim 1, wherein each of the plurality of leveling members includes a plurality of apertures, and wherein the rail system comprises bolts that extend through the apertures to fasten the plurality of leveling members to a ground surface.

6. The rail system of claim 1, wherein the plurality of adjustment mechanisms provide seismic relief to the rail system.

7. A rail system comprising:

a first track;

a second track coupled to the first track;

a leveling member disposed below the first track;

a first adjustment mechanism disposed between the first track and the leveling member, the first adjustment mechanism including a male mating component and a female mating component; and a second adjustment mechanism disposed between the first track and the leveling member, the second adjustment mechanism including a first chain link coupled to the first track and a second chain link coupled to both the first chain link and to the leveling member.

8. The rail system of claim 7, wherein the leveling member is a first leveling member, and further including a second leveling member disposed below the second track, and third and fourth adjustment mechanisms disposed between the second track and the second leveling member.

9. The rail system of claim 8, wherein the third adjustment mechanism includes a male mating component and a female mating component, and wherein the fourth adjustment mechanism includes a first chain link coupled to the second track and a second chain link coupled to both the first chain link of the fourth adjustment mechanism and the second leveling member.

10. The rail system of claim 8, further comprising a third leveling member disposed below the first track adjacent the first leveling member, and fifth and sixth adjustment mechanisms disposed between the first track and the third leveling member.

11. The rail system of claim 10, wherein the fifth adjustment mechanism includes a male mating component and a female mating component, and wherein the sixth adjustment mechanism includes a first chain link coupled to the first track and a second chain link coupled to both the first chain link of the sixth adjustment mechanism and the third leveling member.

12. The rail system of claim 7, wherein the female mating component is coupled to the first track and includes an aperture, and the male mating component is coupled to the leveling member and extends into the aperture.

13. The rail system of claim 7, wherein the first chain link is movable relative to the second chain link.

14. The rail system of claim 7, further comprising a third adjustment mechanism disposed between the first track and the leveling member, the third adjustment mechanism including a first chain link and a second chain link.

15. The rail system of claim 14, wherein the first adjustment mechanism is disposed between the second and third adjustment mechanisms along a longitudinal direction of the track.

16. The rail system of claim 7, wherein the first adjustment mechanism includes a rotatable nut, wherein rotation of the nut varies a distance between the track and the leveling member.

17. The rail system of claim 16, wherein the nut is disposed on the male mating component.

18. The rail system of claim 16, wherein the female mating component includes a cylinder that rests on the nut and an opening that receives the male mating component.

19. The rail system of claim 7, wherein the male mating component includes a base coupled to the leveling member and a rod extending from the base.

20. The rail system of claim 7, wherein the leveling member includes a plurality of apertures, and wherein the rail system comprises bolts that extend through the apertures to fasten the leveling member to a ground surface.

21. The rail system of claim 7, wherein the first and second adjustment mechanisms provide seismic relief to the rail system.

* * * * *